US007571594B2

(12) United States Patent
Pascoe et al.

(10) Patent No.: US 7,571,594 B2
(45) Date of Patent: Aug. 11, 2009

(54) COMPOSITE YARN AND PROCESS FOR PRODUCING THE SAME

(75) Inventors: William M. Pascoe, Inman, SC (US); André M. Goineau, Spartanburg, SC (US); Brenda W. Marcus, Greer, SC (US)

(73) Assignee: Milliken & Company, Spartanburg, SC (US)

( * ) Notice: Subject to any disclaimer, the term of this patent is extended or adjusted under 35 U.S.C. 154(b) by 356 days.

(21) Appl. No.: 11/495,032

(22) Filed: Jul. 28, 2006

(65) Prior Publication Data

US 2008/0022650 A1 Jan. 31, 2008

(51) Int. Cl.
*D02G 3/38* (2006.01)

(52) U.S. Cl. ..... 57/6; 57/11; 57/228

(58) Field of Classification Search ..... 57/224, 57/228, 244–246

See application file for complete search history.

(56) References Cited

U.S. PATENT DOCUMENTS 2,849,785 A * 9/1958 McCullough et al. ..... 428/97
3,643,416 A 2/1972 Andrews et al.
3,691,750 A 9/1972 Waters
3,763,640 A 10/1973 Nagel et al.
3,769,787 A 11/1973 Rosenstein et al.
3,780,515 A 12/1973 Waters
3,831,369 A 8/1974 Northup et al.
3,952,496 A 4/1976 Nagel et al.
3,978,648 A 9/1976 Yamagata et al.
4,003,194 A 1/1977 Yamagata et al.
4,028,874 A 6/1977 Maag et al.
4,162,607 A 7/1979 Spivey
4,164,837 A 8/1979 Maag et al.
4,197,696 A 4/1980 Bock
4,204,392 A 5/1980 Bock
4,226,076 A 10/1980 Griset, Jr.
4,226,077 A 10/1980 Hilbert
4,228,639 A 10/1980 Hunt et al.
4,244,173 A * 1/1981 Lulay ..... 57/227
4,246,747 A * 1/1981 Plunkett et al. ..... 57/245
4,336,683 A 6/1982 Bock et al.
4,346,553 A 8/1982 Schwartz
4,384,449 A 5/1983 Byrnes, Sr. et al.
4,484,433 A 11/1984 Stahlecker et al.
4,484,436 A 11/1984 Nakayama et al.
4,542,619 A 9/1985 Schwartz
4,607,481 A 8/1986 Bell et al.
4,711,191 A 12/1987 Schwartz
5,568,719 A 10/1996 Proctor
5,675,878 A * 10/1997 Brown et al. ..... 28/271
5,688,594 A * 11/1997 Lichscheidt et al. ..... 428/370
6,023,926 A 2/2000 Flynn
6,410,140 B1 6/2002 Land et al.
6,494,922 B1 12/2002 Rhyne et al.
6,513,314 B2 2/2003 Cook (Continued)

*Primary Examiner*—Shaun R Hurley
(74) *Attorney, Agent, or Firm*—Cheryl J. Brickey

(57) ABSTRACT

A process for producing composite yarns comprises the steps of first wrapping a second yarn around the perimeter of and along the length of a first yarn and then heating the yarn intermediate produced by such wrapping to produce a composite yarn. When a heat-shrinkable yarn is used in producing such a composite yarn, the shrinkage of the heat-shrinkable yarn enables the production of composite yarns possessing aesthetic qualities similar to those exhibited by yarns produced by much more complicated processes, such as bouclé and chenille yarns.

6 Claims, 5 Drawing Sheets

U.S. PATENT DOCUMENTS 6,536,200 B1 3/2003 Schwartz
6,539,698 B2 4/2003 Fidan et al.
6,553,749 B2 4/2003 Land et al.
6,606,846 B2 8/2003 Land
6,658,835 B1 12/2003 Bowers
6,855,423 B2 2/2005 Fidan et al.
2003/0187140 A1 * 10/2003 Lintecum et al. ..... 525/178

* cited by examiner

COMPOSITE YARN AND PROCESS FOR PRODUCING THE SAME

FIELD OF THE INVENTION

The invention relates to composite yarns and processes for producing composite yarns.

BRIEF SUMMARY OF THE INVENTION

The invention provides a process for producing a composite yarn and a composite yarn produced thereby. The process for producing the composite yarn of the invention generally comprises the steps of first wrapping a second yarn around the perimeter of and along the length of a first yarn and then heating the yarn intermediate produced by such wrapping to produce a composite yarn. When a heat-shrinkable yarn is used in producing such a composite yarn, the shrinkage of the heat-shrinkable yarn enables the production of composite yarns possessing aesthetic qualities similar to those exhibited by yarns produced by much more complicated processes, such as bouclé and chenille yarns.

In a first embodiment, the process comprises the steps of (a) providing at least a first yarn and a second yarn, (b) wrapping the second yarn around the perimeter of and along at least a portion of the length of the first yarn to produce a yarn intermediate, (c) overfeeding the yarn intermediate to a heating zone and exposing the yarn intermediate to heat, and (d) collecting the composite yarn.

In a second embodiment, the process comprises the steps of (a) providing at least a first yarn and a second yarn, (b) providing a rotary, hollow spindle assembly, (c) providing a heater assembly, (d) providing a yarn collection assembly, (e) passing the first and second yarns through the spindle assembly so that the second yarn is wrapped around the perimeter of and along at least a portion of the length of the first yarn, the wrapped first and second yarns forming a yarn intermediate, (f) overfeeding the yarn intermediate to the heater assembly and exposing the yarn intermediate to heat, and (g) collecting the composite yarn on the yarn collection assembly.

DETAILED DESCRIPTION OF THE INVENTION

Figure 1:
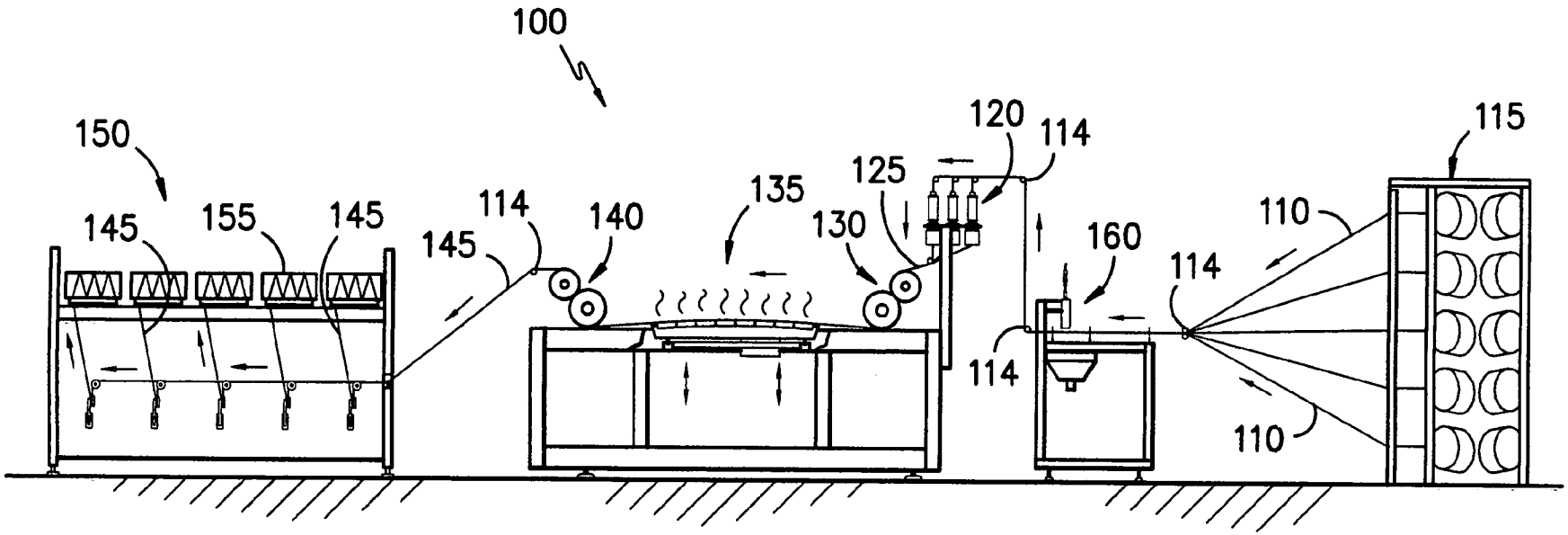
FIG. 1 is a side, elevation view of an apparatus suitable for performing the process of the invention.

The process for producing the composite yarn of the invention generally comprises the steps of first wrapping a second yarn around the perimeter of and along the length of a first yarn and then heating the yarn intermediate produced by such wrapping to produce a composite yarn. In a first embodiment, the process comprises the steps of (a) providing at least a first yarn and a second yarn, (b) wrapping the second yarn around the perimeter of and along at least a portion of the length of the first yarn to produce a yarn intermediate, (c) overfeeding the yarn intermediate to a heating zone and exposing the yarn intermediate to heat, and (d) collecting the composite yarn.

The first and second yarns can be any suitable yarns. The first and second yarns can each independently be a monofilament, multifilament, or spun yarn comprising natural fibers, synthetic fibers, or a combination thereof. For example, in certain possibly preferred embodiments, the first yarn or second yarn can be a thermoplastic yarn comprising fibers selected from the group consisting of polyester fibers, nylon fibers, polyolefin fibers, and combinations thereof. In certain possibly preferred embodiments, the first or second yarn can comprise natural fibers, such as cotton, linen, ramie, jute, hemp, kenaf, sisal, wool, and silk. The first or second yarns can be textured, such as a yarn that has been air-jet or false-twist textured.

In certain possibly preferred embodiments, at least one of the first and second yarns is a heat-shrinkable yarn exhibiting a shrinkage (e.g., a shrinkage in the longitudinal direction of the yarn) upon exposure of the yarn to heat. The heat-shrinkable yarn typically exhibits a shrinkage upon exposure to heat of about 10% or more (e.g., about 15% or more). More specifically, the length of the heat-shrinkable yarn decreases by about 10% or more (e.g., about 15% or more) upon exposure of the yarn to heat. In certain possibly preferred embodiments, the heat-shrinkable yarn exhibits a shrinkage upon exposure to heat of about 20% or more, about 25% or more, about 30% or more, about 35% or more, about 40% or more, or about 45% or more. The shrinkage exhibited by the heat-shrinkable yarn can be measured using any suitable method. For example, the shrinkage can be measured according to the boiling water shrinkage test procedure described in ASTM Standard D2259-02, entitled "Standard Test Method for Shrinkage of Yarns," and is considered to be within the ranges set forth herein when so determined.

The heat-shrinkable yarn can be any suitable yarn exhibiting the desired degree of shrinkage. Suitable heat-shrinkable yarns include, but are not limited to, thermoplastic, partially-oriented yarns (POY). Suitable partially-oriented yarns include, but are not limited to, partially-oriented polyester yarns, partially-oriented nylon yarns, partially-oriented polyolefin yarns, and partially-oriented yarns comprising a combination of any of such fibers (e.g., polyester, nylon, and polyolefin fibers). In certain possibly preferred embodiments, the heat-shrinkable yarn is a partially-oriented polyester yarn. When the heat-shrinkable yarn is a partially-oriented yarn, the partially-oriented yarn preferably is coated with a suitable lubricating oil to reduce friction during the wrapping process which may otherwise result in unintended drawing of the partially-oriented yarn.

As noted above, the second yarn is wrapped around the perimeter of and along the length of the first yarn. In the process of the invention, the second yarn can be wrapped around the first yarn using any suitable means. For example, the first yarn can be fed through the center of a rotary, hollow spindle assembly where the second yarn is fed from the spindle and wrapped around the perimeter of and along the length of the first yarn as it passes through the rotary, hollow spindle assembly. The second yarn can also be wrapped around the first yarn by twisting the first and second yarns together using any suitable yarn twisting apparatus or by cabling the first and second yarns using any suitable apparatus adapted to cable a plurality of yarns. During this process, the wrapping of the second yarn around the first yarn produces a yarn intermediate which is subsequently processed to produce the composite yarn of the invention.

The second yarn can be wrapped around the first yarn at any suitable rate or with any suitable number of turns or twists of the second yarn per unit length of the first yarn. The second yarn typically is wrapped around the first yarn at a rate sufficient to ensure that the composite yarn remains coherent when the yarn or a fabric containing the yarn are subjected to normal wear and tear. Furthermore, the second yarn typically is not wrapped around the first yarn at such a rate such that each twist or turn of the second yarn is contiguous with the adjacent twists or turns of the second yarn along the length of the first yarn. Typically, the second yarn is wrapped around the perimeter of and along the length of the first yarn at the rate of about 0.5 turns or more per centimeter of the first yarn (about 1.25 turns per inch of the first yarn). In certain possibly preferred embodiments, the second yarn is wrapped around the first yarn at a rate of about 0.75 turns or more per centimeter of the first yarn (about 2 turns per inch of the first yarn), about 1 turns or more per centimeter of the first yarn (about 2.5 turns per inch of the first yarn), about 1.4 turns or more per centimeter of the first yarn (about 3.5 turns or more per inch of the first yarn), or about 1.75 or more turns per centimeter of the first yarn (about 4.5 turns or more per inch of the first yarn).

After the second yarn has been wrapped around the first yarn to produce the yarn intermediate, the yarn intermediate is then fed to a heating zone where the yarn intermediate is heated for a time and under conditions sufficient to at least partially shrink any heat-shrinkable yarn contained in the yarn intermediate. In order to allow the heat-shrinkable yarn to shrink along its length or in the longitudinal direction of the yarn intermediate, the yarn intermediate typically is fed to the heating zone at a rate that is faster than the rate at which the resulting composite yarn is collected from the heating zone. This "overfeeding" of the yarn intermediate to the heating zone provides the "slack" necessary to permit shrinkage of the heat-shrinkable yarn. Typically, the yarn intermediate is overfed to the heating zone at a rate of about 10% or more (i.e., the yarn intermediate is fed to the heating zone at a rate that is about 10% or more faster than the rate at which the composite yarn is collected from the heating zone). In certain possibly preferred embodiments, the yarn intermediate is overfed to the heating zone at a rate of about 15% or more, about 20% or more, about 25% or more, about 30% or more, about 35% or more, about 40% or more, about 45% or more, or about 50% or more.

The yarn intermediate can be heated in the heating zone using any suitable means. Typically, the yarn intermediate is heated by passing the yarn intermediate across the surface of a contact heater assembly. The heater assembly can be operated at any suitable temperature. Typically, the heater assembly is operated at a temperature that is sufficiently high so that, during the time that the yarn intermediate is in the heating zone, the yarn intermediate is heated to a temperature sufficient to at least partially shrink the heat-shrinkable yarn. The heater temperature necessary to heat the yarn intermediate to such a degree may depend upon several factors, such as the composition and structure of the yarn intermediate and the amount of time the yarn intermediate is in contact with the heater assembly. In certain possibly preferred embodiments, the heater assembly is maintained at a temperature of about 200° C. or more, about 210° C. or more, about 220° C. or more, or about 230° C. or more.

After the yarn intermediate has been heated to the desired temperature and/or for the desired amount of time, the resulting composite yarn can be collected by any suitable means. For example, the yarn can be wound onto a suitable package using a commercially-available winding apparatus, such as a precision winder or a drum winder. In certain possibly preferred embodiments, the yarn composite is collected in such a manner that substantially no tension (e.g., less than about 15 grams, less than about 10 grams, or less than about 7 grams of tension) is applied to the composite yarn during the collection step. More particularly, the yarn composite can be collected in such a manner that substantially no tension is applied to the composite yarn while the yarn is still hot or warm from the heating step. By collecting the composite yarn in this manner (i.e., with substantially no tension), any drawing of the heat-shrinkable yarn, which has been at least partially shrunk during the heating step, is minimized. The potential for drawing the heat-shrinkable yarn during collection is especially high when the heat-shrinkable yarn is still hot or warm from the heating step, which makes the heat-shrinkable yarn more susceptible to deformation, such as drawing.

In certain possibly preferred embodiments of the process of the invention, the first or second yarns or the yarn intermediate can be intermittently sprayed with water or other suitable fluid prior to feeding of the yarn intermediate to the heating zone. In such an embodiment, the yarn or yarn intermediate is intermittently sprayed with the water or fluid so that the sprayed portion of the yarn is heated to a temperature less than the temperature of the unsprayed portions of the yarn when the yarn intermediate is fed to the heating zone. The heat-shrinkable yarn in those portions which have been sprayed then shrinks to a lesser extent than the unsprayed portions because of the lower temperature to which they are exposed.

Turning to the Figures in which like reference numerals refer to like elements throughout the several views, an apparatus suitable for performing the process of the invention is depicted in FIG. 1. The apparatus 100 generally comprises a creel 115 or other suitable assembly for providing a supply of one or more first yarns 110, a rotary, hollow spindle assembly 120, a heater assembly 135, and a yarn collection assembly 150, such as a precision winder or a drum winder. As depicted in FIG. 1, the apparatus 100 can be configured to simultaneously produce several composite yarns 145.

Figure 2:
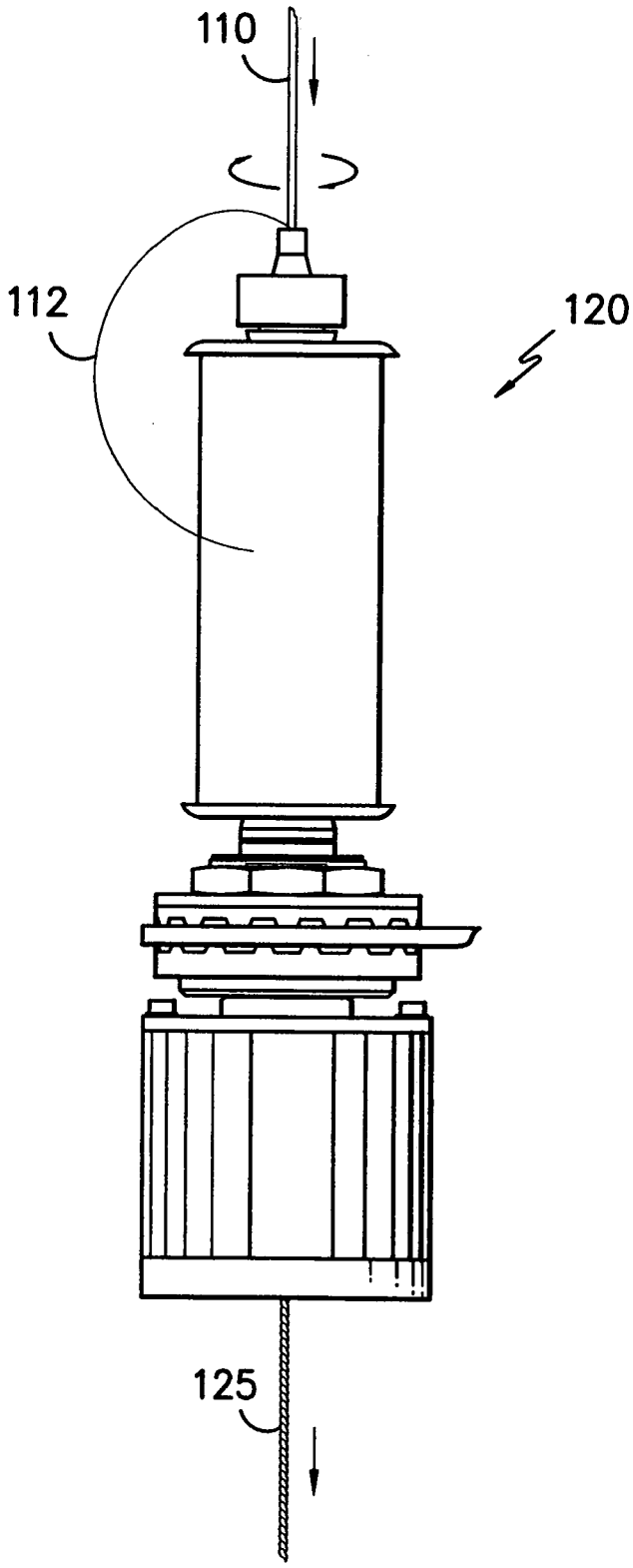
FIG. 2 is a side view of a rotary, hollow spindle assembly suitable for use in the process of the invention.

In operation, the first yarn 110 is drawn from the creel 115 and directed by suitable yarn guides 114 (e.g., satin rolls) so that the first yarn 110 passes through a rotary, hollow spindle assembly 120. As shown in FIG. 2, the first yarn 110 passes through the rotary, hollow spindle assembly 120 as the second yarn 112 is wrapped around the first yarn 110. The yarn intermediate 125 that emerges from the rotary, hollow spindle assembly 120 comprises a first yarn 110 having a second yarn 112 wrapped around the perimeter of and along the length of the first yarn 110. Returning to FIG. 1, the yarn intermediate 125 is then fed by first drive rolls 130 across a heater assembly 135, such as a plate-type, contact heater. The composite yarn 145 produced as the yarn intermediate 125 passes over the heater assembly 135 is then taken off of the heater assembly 135 by second drive rolls 140. The composite yarn is then directed by suitable yarn guides 114 onto a suitable yarn collection assembly 150, and the composite yarn 145 is wound onto a suitable package 155 to be used in subsequent treatment of the composite yarn or fabric formation. As noted above, the yarn intermediate 125 can be overfed onto the heater assembly 135 by driving the first drive rolls 130 at a speed greater than the second drive rolls 140. In certain possibly preferred embodiments, the apparatus 100 can comprise a yarn spraying apparatus 160 that is adapted to intermittently spray the first yarn 110 with water or other suitable fluid as described above. Alternatively, the yarn spraying apparatus 160 can be disposed between the rotary, hollow spindle assembly 120 and the first drive rolls 130 so that the yarn intermediate 125 emerging from the rotary, hollow spindle assembly 120 is sprayed with water or other suitable fluid as described above.

Figure 3:
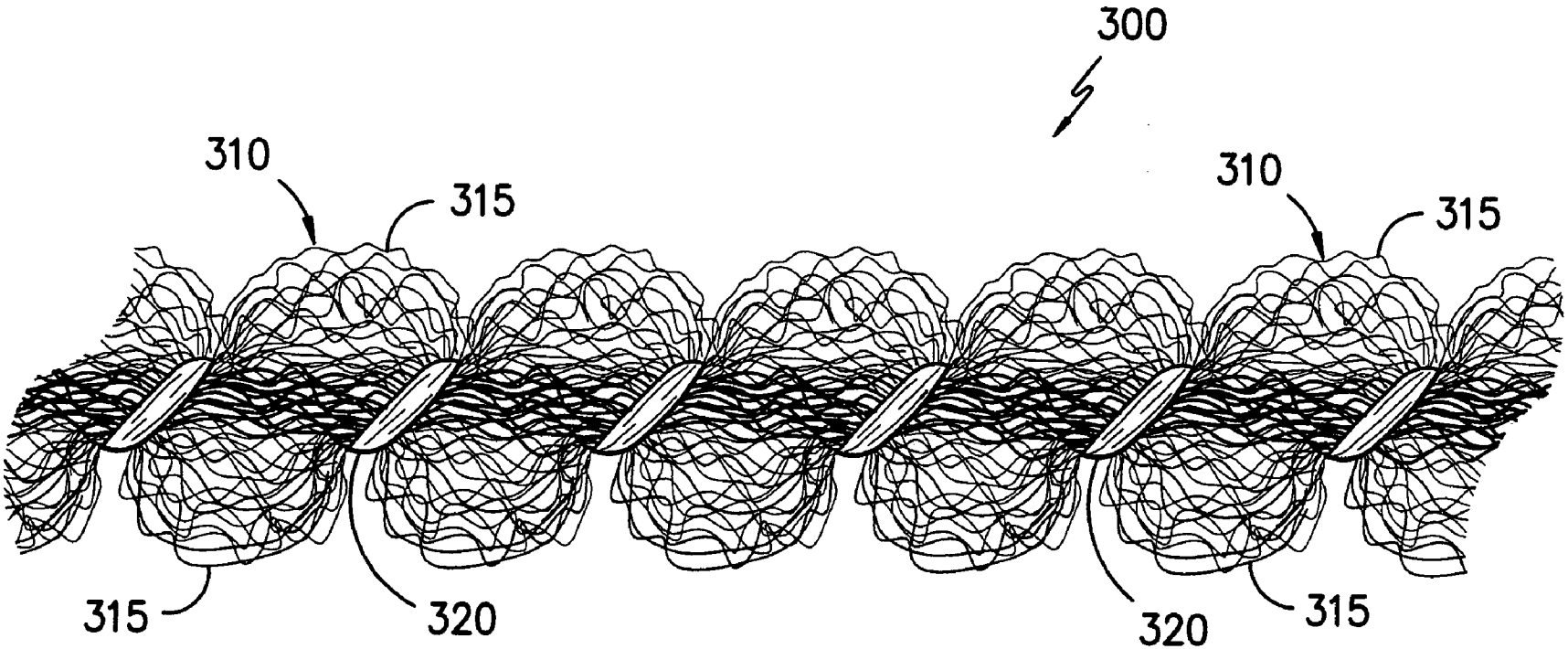
FIG. 3 is a side view of a composite yarn according to the invention.

The composite yarn of the invention generally comprises a first yarn having a second yarn wrapped around its perimeter and along its length. The first and second yarns of the composite yarn can be any suitable yarn, such as those described above in the description of the process of the invention. A composite yarn according to the invention is depicted in FIG. 3. The composite yarn 300 comprises a first yarn 310 and a second yarn 320 wrapped around the perimeter and along the length of the first yarn 310. The first yarn 310 is depicted as a multifilament yarn comprising a plurality of individual filaments 315 that together form the first yarn 310. As shown in FIG. 3, the second yarn 320 is a heat-shrinkable yarn, such as those described above, which has been heated so that the second yarn 320 shrinks along its length and along the length of the composite yarn 300. This shrinkage of the second yarn 320 along its length draws in the first yarn 310 and produces the bulky appearance depicted in FIG. 3.

Figure 4:
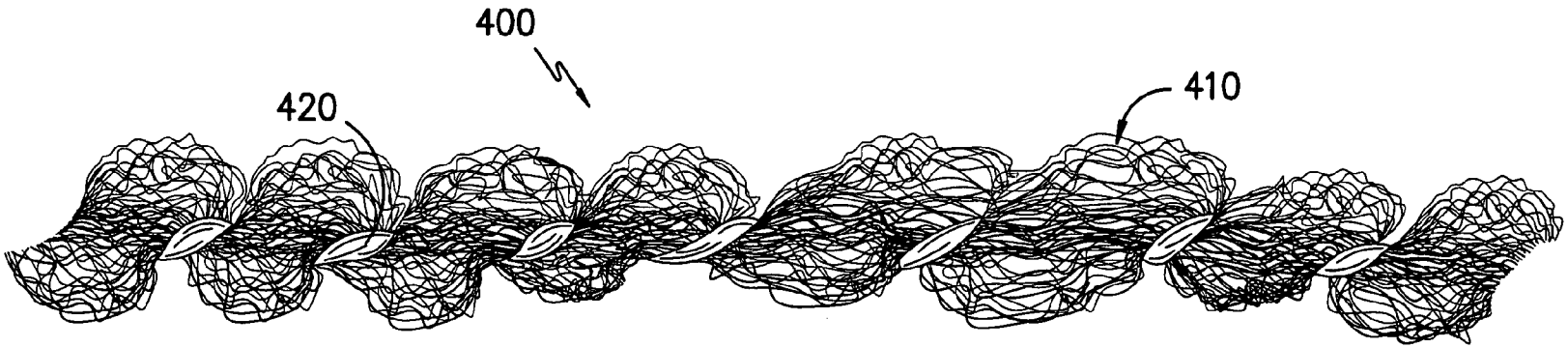
FIG. 4 is a drawing of several segments of a composite yarn similar to that depicted in FIG. 3.

FIG. 4 is a drawing of several segments of a composite yarn according to the invention. The composite yarn 400 in FIG. 4 comprises a first yarn 410 and a second yarn (not visible) together forming a core that is wrapped with a third yarn 420. The first yarn 410 is a 140 denier (160 dtex), 200 filament false twist textured polyethylene terephthalate (PET) yarn, and the second yarn (not visible) is a 255 denier (283 dtex), 34 filament partially-oriented PET yarn. The third yarn 420 is a 115 denier (128 dtex), 34 filament 693T partially-oriented PET yarn that was wrapped around the first yarn 410 and second yarn (not visible) at a rate of about 1.75 turns per centimeter (about 4.5 turns per inch) of the first yarn 410 and second yarn (not visible). After the yarns had been wrapped to produce a yarn intermediate, the intermediate was then heated to produce the composite yarn 400 exhibiting the bulky appearance shown in FIG. 4.

Figure 5:
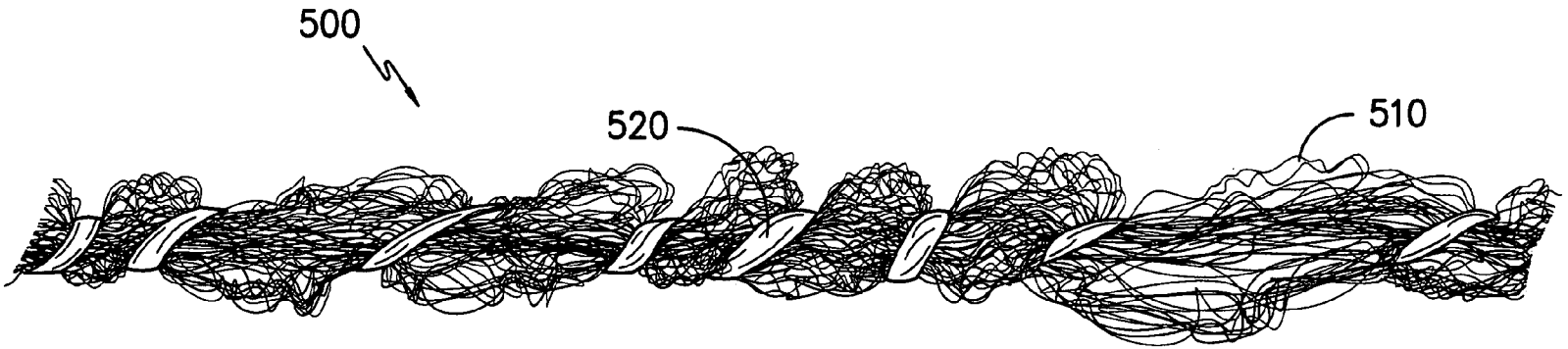
FIG. 5 is a drawing of several segments of a composite yarn according to the invention.

FIG. 5 is a drawing of several segments of another composite yarn according to the invention. The composite yarn 500 comprises a first yarn 510, a second yarn (not visible), and a third yarn 520 wrapped around the perimeter of and along the length of the first yarn 510 and second yarn (not visible). The first yarn is a 225 denier (250 dtex), 200 filament 56T partially-oriented PET yarn, and the second yarn (not visible) is a 255 denier (283 dtex), 34 filament partially-oriented PET yarn. The third yarn 520 is a 115 denier (128 dtex), 34 filament 693T partially-oriented PET yarn which was wrapped around the first yarn 510 and second yarn (not visible) at a rate of about 1.75 turns per centimeter (about 4.5 turns per inch) of the first yarn 510 and second yarn (not visible). The composite yarn 500 was heated so that the yarns shrunk along their length and along the length of the composite yarn 500. This shrinkage of the yarns along their length produces the bulky appearance shown in FIG. 5.

Figure 6:
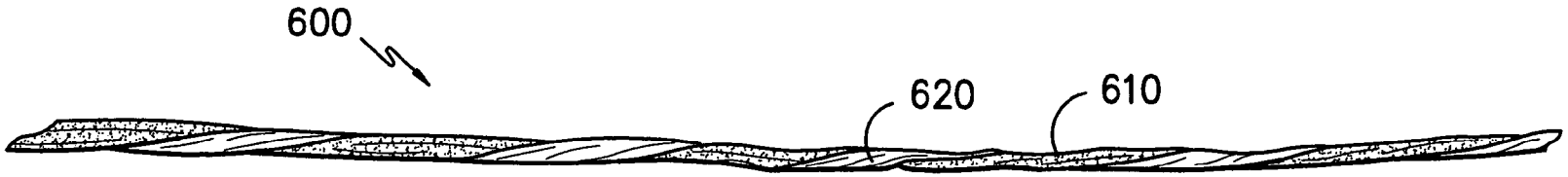
FIG. 6 is a drawing of several segments of a composite yarn according to the invention.

FIG. 6 is a drawing of several segments of another composite yarn according to the invention. The composite yarn 600 comprises a first yarn 610, which is black in color, and a second yarn 620 wrapped around the perimeter of and along the length of the first yarn 610. The first yarn 610 is a 150 denier (170 dtex), 48 filament, warp-drawn, flat core PET yarn, and the second yarn 620 is a 170 denier (190 dtex), 66 filament partially-oriented PET yarn. The second yarn 620 was wrapped around the perimeter of and along the length of the first yarn 610 at a rate of about 1.75 turns per centimeter (about 4.5 turns per inch) of the first yarn 610. The yarn intermediate produced by the wrapping the yarns was then heated to produce the composite yarn shown in FIG. 6.

Figure 7:
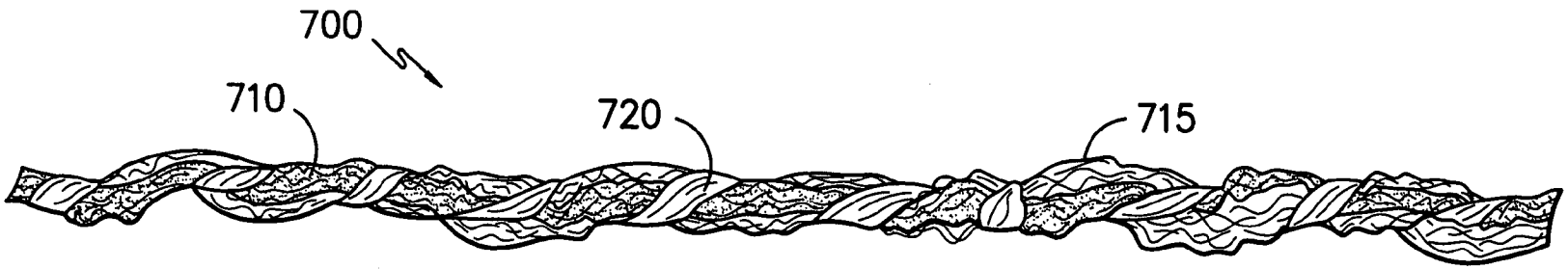
FIG. 7 is a drawing of several segments of a composite yarn according to the invention.

FIG. 7 is a drawing of several segments of another composite yarn according to the invention. The composite yarn 700 comprises a first yarn 710, which is black in color, a second yarn 715, which is white in color, and a third yarn 720 wrapped around the perimeter of and along the length of the first yarn 710 and the second yarn 715. The first yarn 710 is a 170 denier (190 dtex), 66 filament partially-oriented PET yarn, and the second yarn is a 125 denier (139 dtex), 72 filament, cationic dyeable, partially-oriented PET yarn. The third yarn 720 is a 115 denier (128 dtex), 34 filament 693T partially-oriented PET yarn that was wrapped around the first yarn 710 and second yarn 715 at a rate of about 1.75 turns per centimeter (about 4.5 turns per inch) of the first yarn 710 and second yarn 715. The yarn intermediate produced by the wrapping of the yarns has been heated to produce the composite yarn 700 shown in FIG. 7.

While the composite yarn has principally been described above as comprising a first yarn and a second yarn, the composite yarn can comprise any suitable number of individual yarns that have been wrapped to produce a composite yarn. For example, the composite yarn can comprise a plurality of individual yarns disposed in substantially parallel relation to form the "core" of the composite yarn, with one or more individual yarns wrapped around the perimeter of and along the length of this core. One or more heat-shrinkable yarns can be disposed in the core of such a composite yarn or can be wrapped around the perimeter of and along the length of this core.

The following examples further illustrate the invention but, of course, should not be construed as in any way limiting its scope.

Example 1

This example demonstrates the production of a composite yarn according to the invention. A first partially-oriented polyethylene terephthalate (PET) yarn and a textured PET yarn were wrapped with a second partially-oriented PET yarn using a commercially-available rotary, hollow spindle assembly at a rate of approximately 1.75 turns per centimeter of the first partially-oriented PET yarn and textured PET yarn (approximately 4.5 turns per inch). The yarn intermediate produced by such wrapping process had a linear density of approximately 2028 dtex (1825 denier) and was comprised of approximately 53 wt. % of the first partially-oriented PET yarn, approximately 41 wt. % of the textured PET yarn, and approximately 6 wt. % of the second partially-oriented PET yarn. The resulting yarn intermediate was then overfed to a contact heater, which was maintained at a temperature of approximately 230° C., at an overfeed rate of approximately 50%. The composite yarn produced by heating the yarn intermediate was withdrawn from the heater at a rate of approximately 12 meters per minute and wound onto a suitable package under substantially no tension using a commercially-available winder. The composite yarn produced by the process had a linear density of approximately 4100 dtex (3700 denier).

Example 2

This example demonstrates the production of a composite yarn according to the invention. A first partially-oriented PET yarn and a textured PET yarn were wrapped with a second partially-oriented PET yarn using a commercially-available rotary, hollow spindle assembly at a rate of approximately 1.75 turns per centimeter of the first partially-oriented PET yarn and textured PET yarn (approximately 4.5 turns per inch). The yarn intermediate produced by such wrapping process had a linear density of approximately 1994 dtex (1795 denier) and was comprised of approximately 52 wt. % of the first partially-oriented PET yarn, approximately 42 wt. % of the textured PET yarn, and approximately 6 wt. % of the second partially-oriented PET yarn. The resulting yarn intermediate was then overfed to a contact heater, which was maintained at a temperature of approximately 230° C., at an overfeed rate of approximately 50%. The composite yarn produced by heating the yarn intermediate was withdrawn from the heater at a rate of approximately 12 meters per minute and wound onto a suitable package under substantially no tension using a commercially-available winder. The composite yarn produced by the process had a linear density of approximately 4204 dtex (3784 denier).

Example 3

This example demonstrates the production of a composite yarn according to the invention. A textured PET yarn and a first partially-oriented PET yarn were wrapped with a second partially-oriented PET yarn using a commercially-available rotary, hollow spindle assembly at a rate of approximately 1.75 turns per centimeter of the textured PET yarn and first partially-oriented PET yarn (approximately 4.5 turns per inch). The yarn intermediate produced by such wrapping process had a linear density of approximately 628 dtex (565 denier) and was comprised of approximately 46 wt. % of the textured PET yarn, approximately 30 wt. % of the first partially-oriented PET yarn, and approximately 24 wt. % of the second partially-oriented PET yarn. The resulting yarn intermediate was then overfed to a contact heater, which was maintained at a temperature of approximately 230° C., at an overfeed rate of approximately 50%. The composite yarn produced by heating the yarn intermediate was withdrawn from the heater at a rate of approximately 30 meters per minute and wound onto a suitable package under substantially no tension using a commercially-available winder. The composite yarn produced by the process had a linear density of approximately 1140 dtex (1026 denier).

Example 4

This example demonstrates the production of a composite yarn according to the invention. A textured PET yarn and a first partially-oriented PET yarn were wrapped with a second partially-oriented PET yarn using a commercially-available rotary, hollow spindle assembly at a rate of approximately 1.75 turns per centimeter of the textured PET yarn and first partially-oriented PET yarn (approximately 4.5 turns per inch). The yarn intermediate produced by such wrapping process had a linear density of approximately 424 dtex (382 denier) and was comprised of approximately 37 wt. % of the textured PET yarn, approximately 33 wt. % of the first partially-oriented PET yarn, and approximately 30 wt. % of the second partially-oriented PET yarn. The resulting yarn intermediate was then overfed to a contact heater, which was maintained at a temperature of approximately 230° C., at an overfeed rate of approximately 50%. The composite yarn produced by heating the yarn intermediate was withdrawn from the heater at a rate of approximately 30 meters per minute and wound onto a suitable package under substantially no tension using a commercially-available winder. The composite yarn produced by the process had a linear density of approximately 993 dtex (894 denier).

Example 5

This example demonstrates the production of a composite yarn according to the invention. A first partially-oriented PET yarn and a solution-dyed, partially-oriented PET yarn were wrapped with a second partially-oriented PET yarn using a commercially-available rotary, hollow spindle assembly at a rate of approximately 1.75 turns per centimeter of the first partially-oriented PET yarn and solution-dyed, partially-oriented PET yarn (approximately 4.5 turns per inch). The yarn intermediate produced by such wrapping process had a linear density of approximately 850 dtex (765 denier) and was comprised of approximately 63 wt. % of the first partially-oriented PET yarn, approximately 22 wt. % of the solution-dyed, partially-oriented PET yarn, and approximately 15 wt. % of the second partially-oriented PET yarn. The resulting yarn intermediate was then overfed to a contact heater, which was maintained at a temperature of approximately 230° C., at an overfeed rate of approximately 50%. The composite yarn produced by heating the yarn intermediate was withdrawn from the heater at a rate of approximately 30 meters per minute and wound onto a suitable package under substantially no tension using a commercially-available winder. The composite yarn produced by the process had a linear density of approximately 2174 dtex (1957 denier).

Example 6

This example demonstrates the production of a composite yarn according to the invention. Two 83 dtex (75 denier), 48 filament disperse-dyed PET yarns and two 290 dtex (260 denier) solution-dyed, PET yarns are wrapped with a 128 dtex (115 denier), 34 filament partially-oriented PET yarn using a commercially-available rotary, hollow spindle assembly at a rate of approximately 1.75 turns per centimeter of the disperse-dyed PET yarns and solution-dyed PET yarns (approximately 4.5 turns per inch). The yarn intermediate produced by such wrapping process has a linear density of approximately 1100 dtex (1000 denier). The resulting yarn intermediate is then overfed to a contact heater, which is maintained at a temperature of approximately 230° C., at an overfeed rate of approximately 50%. The composite yarn is withdrawn from the heater at a rate of approximately 26 meters per minute and is wound onto a suitable package under substantially no tension using a commercially-available winder. The composite yarn produced by the process has a linear density of approximately 2139 dtex (1925 denier).

Example 7

This example demonstrates the production of a composite yarn according to the invention. A nylon yarn and a first solution-dyed, partially-oriented PET yarn were wrapped with a second solution-dyed, partially-oriented PET yarn using a commercially-available rotary, hollow spindle assembly at a rate of approximately 1.75 turns per centimeter of the nylon yarn and the first solution-dyed, partially-oriented PET yarn (approximately 4.5 turns per inch). The yarn intermediate produced by such wrapping process had a linear density of approximately 4300 dtex (3900 denier) and was comprised of approximately 69 wt. % of the nylon yarn, approximately 26 wt. % of the first solution-dyed, partially-oriented PET yarn, and approximately 5 wt. % of the second solution-dyed, partially-oriented PET yarn. The resulting yarn intermediate was then overfed to a contact heater, which was maintained at a temperature of approximately 230° C., at an overfeed rate of approximately 50%. The composite yarn produced by heating the yarn intermediate was withdrawn from the heater at a rate of approximately 12 meters per minute and wound onto a suitable package under substantially no tension using a commercially-available winder. The composite yarn produced by the process had a linear density of approximately 8700 dtex (7800 denier).

Example 8

This example demonstrates the production of a composite yarn according to the invention. A first partially-oriented PET yarn was wrapped with a second partially-oriented PET yarn using a commercially-available rotary, hollow spindle assembly at a rate of approximately 1.75 turns per centimeter of the first partially-oriented PET yarn (approximately 4.5 turns per inch). The yarn intermediate produced by such wrapping process had a linear density of approximately 410 dtex (370 denier) and was comprised of approximately 69 wt. % of the first partially-oriented PET yarn and approximately 31 wt. % of the second partially-oriented PET yarn. The resulting yarn intermediate was then overfed to a contact heater, which was maintained at a temperature of approximately 230° C., at an overfeed rate of approximately 50%. The composite yarn produced by heating the yarn intermediate was withdrawn from the heater at a rate of approximately 40 meters per minute and wound onto a suitable package under substantially no tension using a commercially-available winder. The composite yarn produced by the process had a linear density of approximately 568 dtex (511 denier).

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A process for producing a composite yarn, the process comprising the steps of:

(a) providing at least a first yarn comprised of polyethylene terephthalate and a second yarn comprised of polyethylene terephthalate, the first yarn having a length and a perimeter, and at least one of the first and second yarns being a heat-shrinkable yarn exhibiting a shrinkage upon exposure to heat of about 20% or more, (b) providing a rotary, hollow spindle assembly, (c) providing a heater assembly, (d) providing a yarn collection assembly, (e) passing the first and second yarns through the spindle assembly so that the second yarn is wrapped around the perimeter of and along at least a portion of the length of the first yarn, the wrapped first and second yarns forming a yarn intermediate, (f) overfeeding the yarn intermediate to the heater assembly and exposing the yarn intermediate to heat sufficient to at least partially shrink the heat-shrinkable yarn and thereby produce a polyethylene terephthalate composite yarn, wherein the yarn intermediate is overfed to the heater assembly at an overfeed rate of at least about 20%, and (g) collecting the polyethylene terephthalate composite yarn on the yarn collection assembly, the yarn composite being collected such that substantially no tension is applied to the polyethylene terephthalate composite yarn during collection.

2. The process of claim 1, wherein the heat-shrinkable yarn exhibits a shrinkage upon exposure to heat of about 30% or more.

3. The process of claim 2, wherein the heat-shrinkable yarn exhibits a shrinkage upon exposure to heat of about 35% or more.

4. The process of claim 1, wherein the yarn intermediate is overfed to the heater assembly at an overfeed rate of about 30% or more.

5. The process of claim 4, wherein the yarn intermediate is overfed to the heater assembly at an overfeed rate of about 40% or more.

6. The process of claim 1, wherein the second yarn is a heat-shrinkable yarn.

* * * * *